US010799422B2

(12) United States Patent
Williams et al.

(10) Patent No.: US 10,799,422 B2
(45) Date of Patent: Oct. 13, 2020

(54) SAMPLE COLLECTION KIT INCLUDING REMOVABLE STOPPER

(71) Applicant: SPECTRUM SOLUTIONS L.L.C, Draper, UT (US)

(72) Inventors: Kevin Gregg Williams, Draper, UT (US); William Michael Phillips, Draper, UT (US)

(73) Assignee: SPECTRUM SOLUTIONS L.L.C., Draper, UT (US)

( * ) Notice: Subject to any disclaimer, the term of this patent is extended or adjusted under 35 U.S.C. 154(b) by 531 days.

(21) Appl. No.: 15/692,259

(22) Filed: Aug. 31, 2017

(65) Prior Publication Data

US 2018/0344568 A1 Dec. 6, 2018

Related U.S. Application Data

(60) Provisional application No. 62/529,355, filed on Jul. 6, 2017, provisional application No. 62/512,594, filed on May 30, 2017.

(51) Int. Cl.
*A61J 1/14* (2006.01)
*B01L 3/00* (2006.01)

(52) U.S. Cl.
CPC ..... *A61J 1/1418* (2015.05); *A61J 1/1481* (2015.05); *B01L 3/5082* (2013.01);
(Continued)

(58) Field of Classification Search
CPC ..... A61J 9/00; A61J 1/1418; A61J 1/1425; A61J 1/1431; A61J 1/1412; A61J 1/1481;
(Continued)

(56) References Cited

U.S. PATENT DOCUMENTS 3,792,699 A 2/1974 Tobin et al.
3,878,571 A * 4/1975 Seeley ..... A61B 10/007 4/144.1

(Continued)

OTHER PUBLICATIONS

Office Action issued in U.S. Appl. No. 14/952,712 dated Dec. 15, 2017.

(Continued)

*Primary Examiner* — Susan S Su
(74) *Attorney, Agent, or Firm* — Workman Nydegger

(57) ABSTRACT

A biological sample collection system includes a sample collection vessel having an opening disposed at a top portion thereof and a sample collection chamber having sample preservation reagent disposed therein and which is in fluid communication with the opening. The system additionally includes a funnel configured to selectively couple to the opening such that the funnel opening and the opening of the sample collection vessel are in fluid communication when the funnel coupled to the opening. The system also includes a removable stopper having a plug that is configured to seal the opening and/or the funnel opening. In some embodiments, a biological sample collection system includes a sample collection chamber having an opening disposed at a top portion thereof, a sample preservation reagent disposed with in the sample collection chamber, a funnel configured to selectively couple to the opening and including a ramp, and a removable stopper having a plug configured to seal the opening and a tapered ridge configured to selectively engage the ramp.

19 Claims, 7 Drawing Sheets

(52) U.S. Cl.
CPC ..... *B01L 2200/16* (2013.01); *B01L 2300/042* (2013.01); *B01L 2300/0609* (2013.01); *B01L 2300/0832* (2013.01)

(58) Field of Classification Search
CPC ... A61J 1/1475; A61J 1/1487; A61B 10/0051; B01L 3/523; B01L 3/527; B01L 3/52; B01L 3/508; B01L 3/5082
See application file for complete search history.

(56) References Cited

U.S. PATENT DOCUMENTS

| | | | | | |
|---|---|---|---|---|---|
| 4,311,792 | A | | 1/1982 | Avery | |
| 4,589,548 | A | * | 5/1986 | Fay | A61B 10/0051 206/363 |
| 4,741,346 | A | * | 5/1988 | Wong | A61B 10/0051 600/573 |
| 4,761,379 | A | * | 8/1988 | Williams | A61B 10/0051 206/569 |
| 4,920,975 | A | * | 5/1990 | Fay | A61B 10/0051 600/573 |
| 4,932,081 | A | * | 6/1990 | Burns | A61B 10/0051 206/569 |
| 5,266,266 | A | | 11/1993 | Nason | |
| 7,482,116 | B2 | | 1/2009 | Birnboim | |
| 8,137,958 | B2 | | 3/2012 | Grimes | |
| 9,138,747 | B2 | | 9/2015 | Williams | |
| 9,523,115 | B2 | | 12/2016 | Birnboim | |
| 9,732,376 | B2 | | 8/2017 | Oyler et al. | |
| 10,189,020 | B2 | * | 1/2019 | Williams | A61B 10/0045 |
| 10,525,473 | B2 | * | 1/2020 | Williams | B01L 3/502 |
| 2003/0143752 | A1 | | 7/2003 | Feldsine et al. | |
| 2004/0014237 | A1 | | 1/2004 | Sugiyama | |
| 2004/0237674 | A1 | * | 12/2004 | Wu | A61B 10/0051 73/864 |
| 2006/0216196 | A1 | | 9/2006 | Satoh | |
| 2006/0245977 | A1 | * | 11/2006 | Bodner | A61B 10/0045 422/400 |
| 2008/0260581 | A1 | | 10/2008 | Rosman | |
| 2009/0023219 | A1 | | 1/2009 | Perez | |
| 2009/0216213 | A1 | * | 8/2009 | Muir | A61B 10/0051 604/414 |
| 2011/0212002 | A1 | * | 9/2011 | Curry | B01L 3/5029 422/430 |
| 2012/0046574 | A1 | * | 2/2012 | Skakoon | A61B 10/0051 600/579 |
| 2012/0220043 | A1 | | 8/2012 | Sangha | |
| 2012/0308448 | A1 | * | 12/2012 | Wong | A61B 10/0051 422/558 |
| 2013/0011311 | A1 | | 1/2013 | Kim | |
| 2013/0209993 | A1 | | 8/2013 | Aronowitz | |
| 2013/0248045 | A1 | * | 9/2013 | Williams | A61B 10/0045 141/1 |
| 2014/0051178 | A1 | | 2/2014 | Niggel et al. | |
| 2015/0140681 | A1 | * | 5/2015 | Meng | B01L 3/5023 436/501 |
| 2015/0190122 | A1 | * | 7/2015 | Butlin | A61B 10/0051 600/573 |
| 2015/0343438 | A1 | * | 12/2015 | Williams | A61B 10/0045 422/550 |
| 2017/0001191 | A1 | | 1/2017 | Abogen | |
| 2017/0350797 | A1 | | 12/2017 | Estep | |
| 2019/0200966 | A1 | * | 7/2019 | Zhan | A61B 10/0096 |

OTHER PUBLICATIONS

International Search Report issued in PCT/US2018/030681 dated Jul. 12, 2018.

* cited by examiner

SAMPLE COLLECTION KIT INCLUDING REMOVABLE STOPPER

CROSS-REFERENCE TO RELATED APPLICATIONS

This Application claims the benefit of U.S. Provisional Application No. 62/529,355, filed Jul. 6, 2017, and U.S. Provisional Application No. 62/512,594, filed May 30, 2017, the disclosures of which are incorporated by reference.

BACKGROUND

Technical Field

This disclosure generally relates to vials and vessels for collecting and storing biological samples. More specifically, the present disclosure relates to systems and kits for the collection and preservation of biological samples for future testing in a laboratory or other biological sample analysis facility.

Related Technology

Field collection of biological samples can provide scientists, physicians, geneticist, epidemiologists, or similar personnel with valuable information. For example, access to a fresh sample of a patient's blood, purulent discharge, or sputum sample can help a physician or epidemiologist isolate or identify a causative agent of infection. Similarly, a saliva sample can permit a scientist or geneticist access to the requisite nucleic acid for genetic sequencing, phylotyping, or other studies. In the foregoing examples, in addition to many other situations, it is desirable to work with a fresh biological sample to ensure procurement of accurate results. However, isolation of the probative composition (e.g., nucleic acid, proteins, chemicals, etc.) often requires use of specialized equipment and is often benefited from controlled laboratory conditions.

It can be inconvenient and sometimes improbable to require patients/individuals to travel to a biological sample collection center having the appropriate equipment and desirable controlled environment for sample preparation. Similarly, it may be difficult for personnel to directly access the patient/individual, particularly if the individual sample size is large and/or geographically diverse (e.g., as can be found in large genetic studies of thousands of individuals across an entire country, ethnic population, or geographic region). Further complicating this issue, it is often beneficial to immediately process any procured biological sample, and field personnel may lack access to appropriate specialized equipment or a controlled environment.

Some biological sample collection devices and kits have addressed some of the foregoing issues. For example, some commercial kits provide a user with a vial for receiving a biological sample and a stock of preservation reagents that can be added to the collected biological sample, acting to preserve elements within the biological sample (to a certain extent and for a period of time). However, it is often the case that implementations of self-collection systems rely on inexperienced or untrained individuals to deposit the biological sample within the receiving vessel. This presents a number of problems, including, for example, the technical training and precise measurements often required to properly preserve the biological sample for later processing. In the absence of such, it is important to provide a biological sample collection system that can be easily implemented by a novice user and which can preserve the received biological sample for later processing.

Accordingly, there are a number of disadvantages with biological sample collection and preservations systems that can be addressed.

BRIEF SUMMARY

Implementations of the present disclosure solve one or more of the foregoing or other problems in the art with kits, apparatus, and methods for collecting and preserving a biological sample. In particular, one or more implementations can include a kit for collecting and preserving a biological sample. An exemplary kit includes a sample collection vessel having an opening disposed at a top portion of the sample collection vessel, a sample collection chamber in fluid communication with the opening, the sample collection chamber having a sample preservation reagent disposed therein, and a connection member disposed on an exterior portion of the sample collection vessel. The exemplary kit also includes a funnel coupled to the sample collection vessel, a removable stopper disposed through the funnel and in the opening of the sample collection vessel and creating a fluid-tight seal, and a sealing cap. The sealing cap includes a seal configured to seal the opening and a complementary connection member configured to associate with the connection member of the sample collection vessel such that, when the complementary connection member associates with the connection member, the seal engages and seals the opening.

The present disclosure also includes biological sample collection systems. In some embodiments, a biological sample collection system includes a sample collection vessel, a removable stopper, and a sealing cap. The sample collection vessel includes an opening disposed at a top portion of the sample collection vessel and a sample collection chamber in fluid communication with the opening. The sample collection chamber includes a sample preservation reagent disposed therein. The sample collection vessel also includes a connection member disposed on an exterior portion of the sample collection vessel. The removable stopper includes a plug that is sized and shaped to fit within the opening. The sealing cap includes a seal configured to seal the opening and a complementary connection member configured to associate with the connection member of the sample collection vessel such that when the complementary connection member associates with the connection member, the seal engages and seals the opening.

In some embodiments, the biological sample collection system includes a sample collection chamber having an opening disposed at a top portion of the sample collection chamber and threads disposed an interior sidewall of the sample collection chamber. The sample collection system also includes a sample preservation reagent disposed with in the sample collection chamber, a removable stopper having a plug with external threads configured to engage the threads of the interior sidewall of the sample collection chamber, and a sealing cap configured to associate with the opening to create an airtight or fluid-tight seal.

The present disclosure also includes methods for collecting and preserving a biological sample in a sample collection vessel. An exemplary method includes displacing a removable stopper from an opening of a sample collection chamber, receiving a biological sample from a user through the opening such that the biological sample mixes with a preservation reagent disposed within the sample collection chamber, and sealing the opening. In some embodiments, the biological sample is received from a mouth of the user by a funnel coupled to and in fluid communication with the opening, and subsequent to receiving the biological sample, the funnel is removed and the opening is sealed by coupling a sealing cap to the sample collection vessel.

Accordingly, systems, methods, and kits for collecting a biological sample are disclosed. This summary is provided to introduce a selection of concepts in a simplified form that are further described below in the detailed description. This summary is not intended to identify key features or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims, or may be learned by the practice of the disclosure as set forth hereinafter.

BRIEF DESCRIPTION OF THE DRAWINGS

In order to describe the manner in which the above recited and other advantages and features of the disclosure can be obtained, a more particular description of the disclosure briefly described above will be rendered by reference to specific embodiments thereof, which are illustrated in the appended drawings. It is appreciated that these drawings depict only typical embodiments of the disclosure and are not therefore to be considered to be limiting of its scope. The disclosure will be described and explained with additional specificity and detail through the use of the accompanying drawings in which.

DETAILED DESCRIPTION

Figure 1:
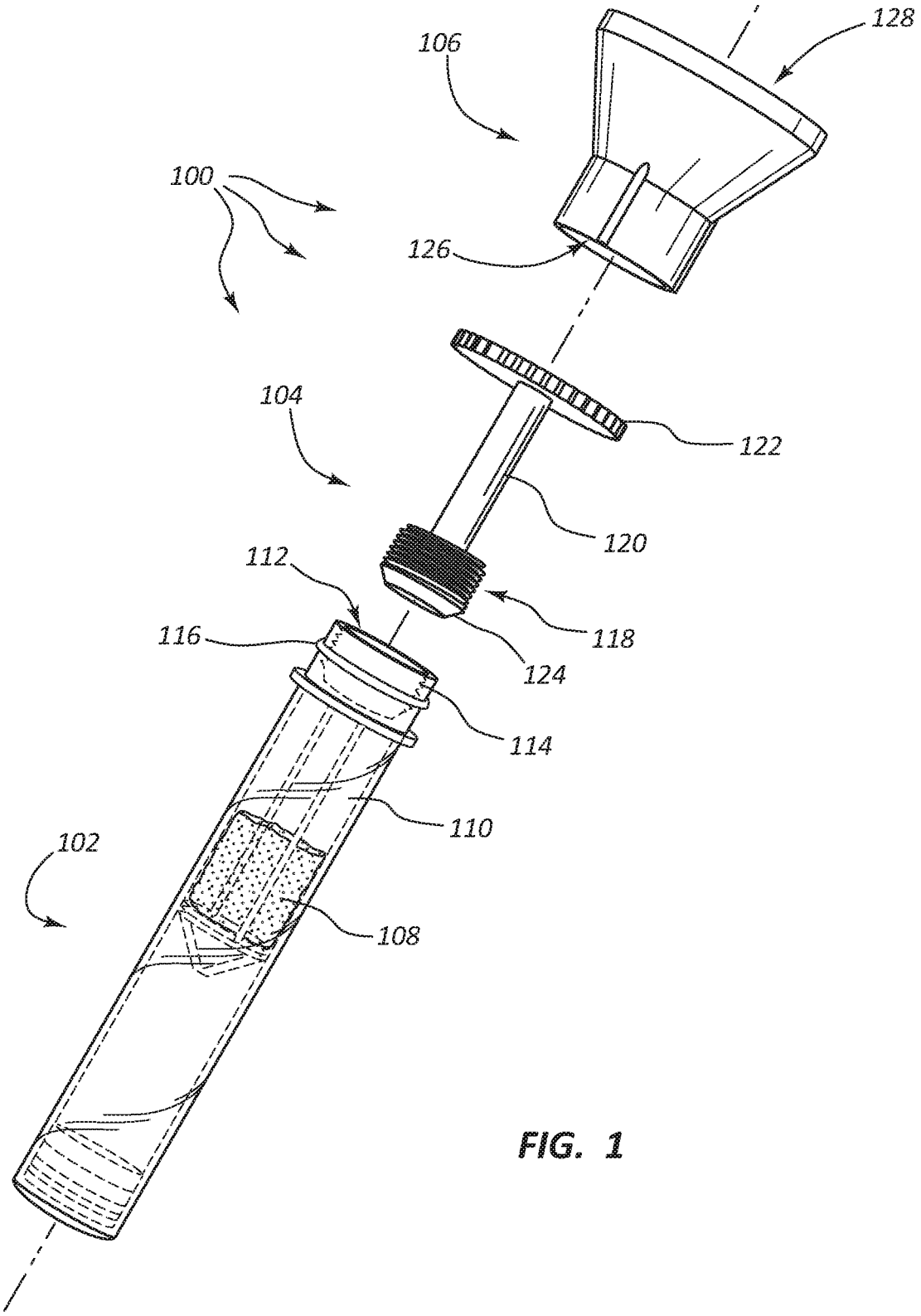
FIG. 1 illustrates an exploded view of an exemplary sample collection system of the present disclosure.

Before describing various embodiments of the present disclosure in detail, it is to be understood that this disclosure is not limited to the parameters of the particularly exemplified systems, methods, apparatus, products, processes, and/or kits, which may, of course, vary. Thus, while certain embodiments of the present disclosure will be described in detail, with reference to specific configurations, parameters, components, elements, etc., the descriptions are illustrative and are not to be construed as limiting the scope of the claimed invention. In addition, the terminology used herein is for the purpose of describing example embodiments, and is not necessarily intended to limit the scope of the claimed invention.

The present disclosure enables systems for collecting and preserving a biological sample. As described in more detail below, a biological sample collection system can include a sample collection vessel, a funnel attached thereto, and a removable stopper. The sample collection vessel can be pre-loaded with a biological sample preservation reagent, and the removable stopper acts to occlude and/or temporarily seal an opening in the sample collection vessel, thereby preventing the reagent from spilling outside the sample collection vessel. In an exemplary implementation, a user receives a sample collection system having a funnel and removable stopper associated with a reagent-filled sample collection vessel. The removable stopper is disassociated with the sample collection vessel, revealing an opening through which a user can deposit the biological sample (e.g., saliva, sputum, blood, mucus, etc.). The funnel can operably increase the diameter of the opening and guide a deposited biological sample to the opening of the sample collection vessel, making it easier for a user to deposit the biological sample within the sample collection vessel. Once a biological sample has been received within the sample collection vessel, the removed stopper can be replaced within the opening to reestablish a fluid-tight and/or airtight seal, or alternatively, a sealing cap can be associated with the sample collection vessel to seal the contents therein. In some embodiments, the funnel is removed before associating the sealing cap with the sample collection vessel.

The systems, methods, and kits disclosed herein provide advantages over other biological sample collection systems and kits. For example, embodiments disclosed herein enable a user to deposit a biological sample directly into sample preservation reagent that has been preloaded within the sample collection vessel. This decreases the potential for user error in measuring an appropriate aliquot of reagent and also decreases the amount of time between user deposition of the biological sample and pre-processing and/or preservation thereof. Accordingly, an unskilled and/or untrained user can effectively perform a complicated task that would otherwise require training or supervision. Further, embodiments of the present disclosure can be implemented in a minimal number of easily performed steps, making it more user friendly and decreasing potential user error.

Referring now to the drawing, FIG. 1 is an exploded view of an exemplary sample collection system 100. The sample collection system 100 includes a sample collection vessel 102, a removable stopper 104, and a funnel 106. The sample collection vessel 102 includes a sample collection chamber 110 and, as illustrated, the sample collection chamber 110 can include a conical base connected to a cylindrical body. It should be appreciated, however, that other geometries are considered within the scope of the invention. The sample collection chamber may include a polygonal geometry or an arcuate geometry or a combination thereof.

The sample collection vessel 102 also includes a volume of sample preservation reagent 108 disposed within the sample collection chamber 110. In some embodiments, the reagent 108 includes a preservation or buffering solution and serves to protect the integrity of the sample prior to purification or testing. Preservation fluids are typically chemical solutions and may contain one or more of various salts (e.g., NaCl, KCl, $Na_2HPO_4$, $KH_2PO_4$, or similar and which may, in some implementations be combined as a phosphate buffered saline solution, as known in the art), lysing agents (e.g., detergents such as Triton X-100 or similar), chelating agents (e.g., ethylenediaminetetraacetic acid (EDTA), ethylene glycol-bis(β-aminoethyl ether)-N,N,N',N'-tetraacetic acid (EGTA), or similar), proteases, distilled water, or other reagents known in the art. In one or more embodiments, the reagent or buffering solution stabilizes at least one element or compound within the sample (e.g., nucleic acids, such as DNA and RNA, protein, and combinations thereof) during transfer, transportation, and/or storage at a laboratory, clinic, or other destination. In some embodiments, the sample can be stored at room temperature after the preservation solution is added.

As illustrated in FIG. 1, the sample collection vessel 102 also includes an opening 112 configured to receive a biological sample (e.g., through funnel 106 associated with the sample collection vessel 102 or directly from a user) and a connection member 116 disposed on an exterior portion of the sample collection vessel. In some embodiments, the connection member 116 can be used to independently attach a funnel or a sealing cap (e.g., the sealing caps shown in FIGS. 8-11) to the sample collection vessel 102. The connection member 116 can include any interlocking or mechanically coupling mechanism known in the art, such as threads, snap or press fit connections, tongue and groove members, bayonet connection, or similar. For example, the connection member may comprise a ridge with which a complementary connection member (e.g., a hook, ridge or recess) disposed on a funnel and/or sealing cap interacts to form an interlocking and/or interference fit.

As illustrated in FIG. 1 the removable stopper 104 includes a stem 120 with a plug 118 coupled to a first end of the stem 120 and a handle 122 coupled to a second end thereof. In some embodiments, the stem is not present. Instead, the plug and handle are coupled directly to each other or are the same element. In some embodiments, the plug 118 can include a sealing mechanism 124 disposed at a distal end and which is operable to create a seal within the opening 112 of the sample collection vessel 102.

The handle 122 of the removable stopper 104 is operable to manipulate the removable stopper and can increase the ease by which a user can interact with and manipulate the removable stopper. For example, the handle 122 can be used to insert or remove the plug from the opening. The handle is shown in FIG. 1 as being disc-shaped. However, it should be appreciated that the handle can have other shapes or configurations, exemplary embodiments of which are shown in FIGS. 4-7 and which are discussed farther below.

The biological sample collection system 100 of FIG. 1 additionally includes a funnel 106. The funnel is configured to attach to the sample collection vessel, for receiving at least a portion of a removable stopper, and for receiving a biological sample and directing said biological sample to and/or through the opening of the sample collection vessel. For example, the bottom opening 126 of the funnel 106 can be sized and shaped to fit over, fit in, or abut the sample collection vessel. In some embodiments, the funnel includes an interior flange that rests on the opening. Additionally, or alternatively, the funnel includes an interior surface that seamlessly (or without substantial gaps or discontinuities that would cause deposited biological sample to leak outside the funnel-collection vessel interaction region) directs a fluid sample to the opening and/or interior surface of the sample collection chamber 110. As shown, the top opening 128 of the funnel 106 is larger in diameter than the opening 112 such that when the funnel is attached to the sample collection vessel 102, the top opening 128 operably increases the diameter of the opening 112, making it easier to deposit a biological sample into the sample collection chamber 110 through opening 112.

Figure 2A:
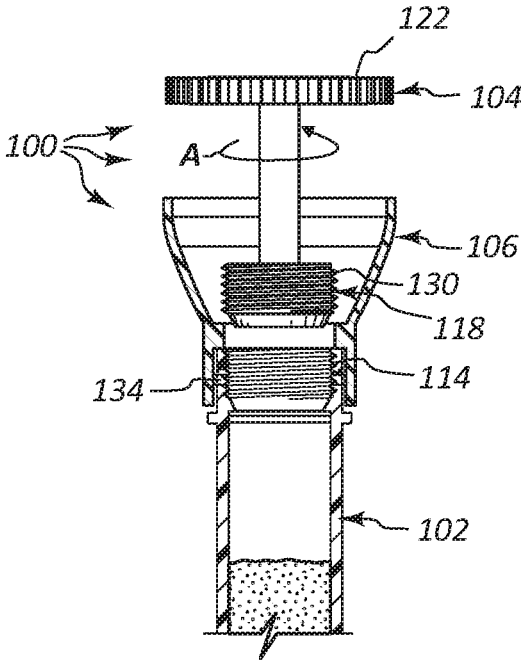
FIG. 2A illustrates a front cross-sectional view of a partially assembled sample collection system.
Figure 2B:
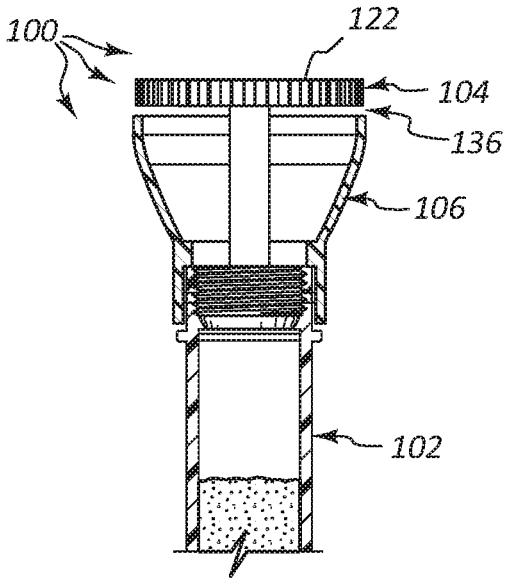
FIG. 2B illustrates the sample collection system of FIG. 2A in an assembled state.

Referring now to FIGS. 2A and 2B, illustrated are front profile cross-sections of partially assembled (FIG. 2A) and fully assembled (FIG. 2B) sample collection systems 100. As shown in FIG. 2A, the funnel 106 can be attached to the sample collection vessel 102 via interlocking threads. Particularly, the connection member on the exterior surface of the sample collection vessel 102 comprises threads 134 that interact with threads disposed on an interior surface of the funnel 106. In the partially assembled state, the removable stopper 104 is partially disposed within the funnel, with the plug 118 being adjacent to the opening of the sample collection vessel. The plug 118 is illustrated as having threads 130 disposed on an exterior surface and which are configured to interlock with corresponding threads 114 on an interior surface of the sample collection chamber. In some embodiments, the threads 114 are disposed on an interior sidewall of the sample collection chamber 110 beginning at or near the opening 112 and extending at least partially along the interior sidewall towards the bottom of the sample collection chamber 110. For example, the threads may be disposed along a brief upper portion of the sidewall at a position that allows engagement of a threaded plug 118.

As shown by arrow A, the removable stopper 104 can be advanced from into the opening and secured therein by turning the handle 122. In some embodiments, the handle 122 may advantageously include ridges or grooves, e.g., like a coin or poker chip, to enhance grip by a user's fingers and/or engagement with a removal tool. In some embodiments, the thread pattern between the plug and the interior surface of the sample collection chamber is opposite from the thread pattern between the funnel and the sample collection vessel such that loosening the removable stopper from the opening causes the funnel to tighten or otherwise does not loosen the funnel from the collection vessel 102.

As shown in FIG. 2B, the sample collection system 100 is in an assembled state. The plug 118 is fully engaged within the opening, creating a fluid-tight and/or airtight seal. In this state, the handle 122 can be disposed a distance away from the top opening or outer rim of the funnel 106 by a space 136. It should be appreciated, however, that the stem of the removable stopper can be any length and can be adjusted to serve any purpose. For example, the stem can be a measured length such that when the removable stopper is associated with the opening of the sample collection vessel, the handle is positioned so that the user can easily interact with it. As shown in FIG. 2B, the stem can be of a length such that when the sample collection system is an assembled state (e.g., the removable stopper is fully engaged within the opening), the handle is raised above the funnel at a desired level (e.g., space 136) to allow a user to grip the edge/sides of the handle.

It should be appreciated that in some embodiments, the length of the stem can be adjusted or manufactured at a different height such that when the sample collection system is in an assembled state (as above), the handle is flush with the top of the funnel. In some embodiments, the handle may act to create a seal (e.g., an airtight seal) with the funnel when the removable stopper is fully engaged with the opening of the sample collection vessel, e.g., to prevent contamination.

Figure 3A:
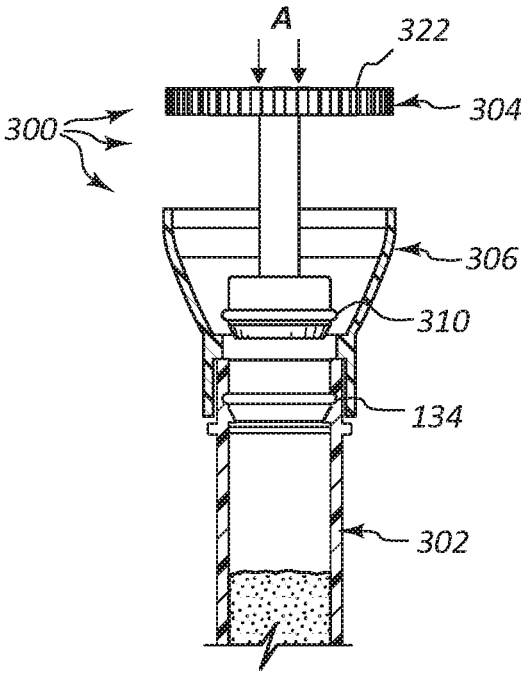
FIG. 3A illustrates front cross-sectional view of another partially assembled sample collection system.
Figure 3B:
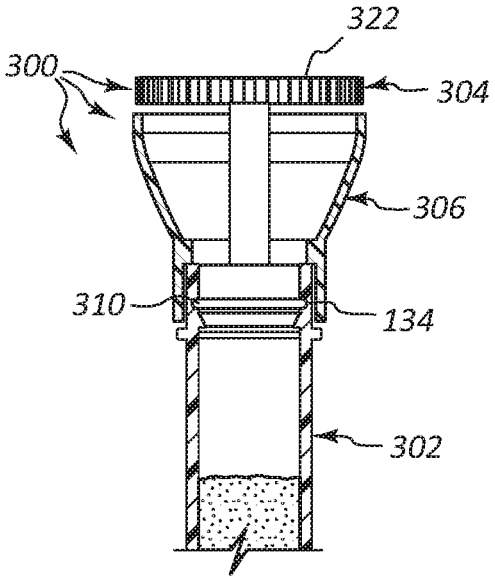
FIG. 3B illustrates the sample collection system of FIG. 3A in an assembled state.

Referring now to FIGS. 3A and 3B, other embodiments illustrating a partially assembled and fully assembled sample collection system 300 are shown. The sample collection system 300 is substantially similar to the sample collection system 100 of FIGS. 1, 2A, and 2B. However, instead of threads 130 disposed on an exterior surface of the plug 118, the plug illustrated in FIG. 3A includes a seal 310 that fits within a corresponding recess 134 to create a fluid-tight and/or airtight seal. In some embodiments, the seal 310 is an O-ring, which can be sized to create a fluid-tight and/or airtight seal simply through compressive forces between the seal 310 and the interior sidewall of the sample collection vessel 302. As illustrated by arrows A, the plug can be pushed into the opening by a force applied to the handle 322 in the direction of the opening. As shown in FIG. 3B, the removable stopper creates a fluid-tight and/or airtight seal in an assembled state.

Figure 4:
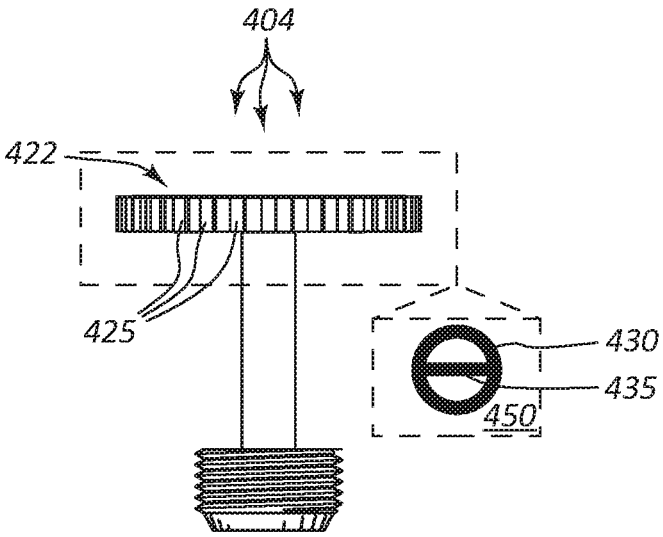
FIG. 4 illustrates a front profile view of an exemplary removable stopper.

Referring now to FIGS. 4-7, illustrated are exemplary embodiments of removable stoppers that can be used in one or more sample collection systems disclosed herein. In each of FIGS. 4-7, the stems and plugs are the same, but the handles are different. Further, each of FIGS. 4-7 include a front profile view of the exemplary removable stopper and a hashed box that represents an aerial view of the representative handle. For example, FIG. 4 illustrates a removable stopper 404 having a disc-shaped handle 422. The edges of the disc-shaped handle 422 include gripping members 425 (e.g., ridges, bumps, or tread patterns of a same or different material to increase gripability of the handle). As shown in the accompanying aerial view, the disc-shaped handle 422 includes apertures 430 that can be used to aid in manipulation of the handle. In some embodiments, the apertures are recesses and/or depressions in the surface 435 of the handle 422.

Figure 5:
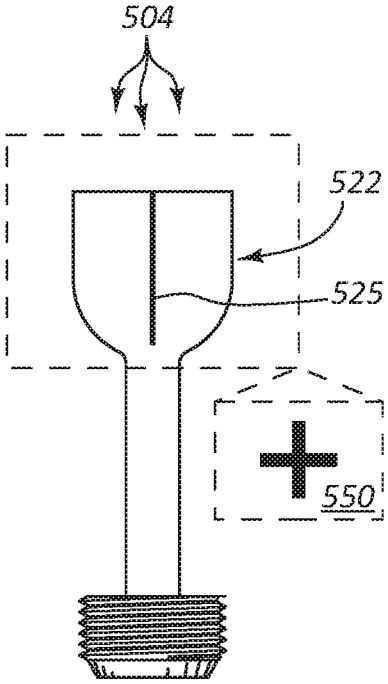
FIG. 5 illustrates a front profile view of another exemplary removable stopper.

FIG. 5 illustrates a removable stopper 504 having a fin-shaped handle 522 having a plurality of flanges 525. Each flange 525 comprises an elongate ridge disposed along and projecting outwardly away from a central body of the fin-shaped handle 522. As shown in the accompanying aerial view, the fin-shaped handle 522 includes four flanges with each flange being oriented orthogonal to at least one other flange. In some embodiments, the flanges are arcuate and can, for example, flare out in a radial pattern from a central body of the handle.

Figure 6:
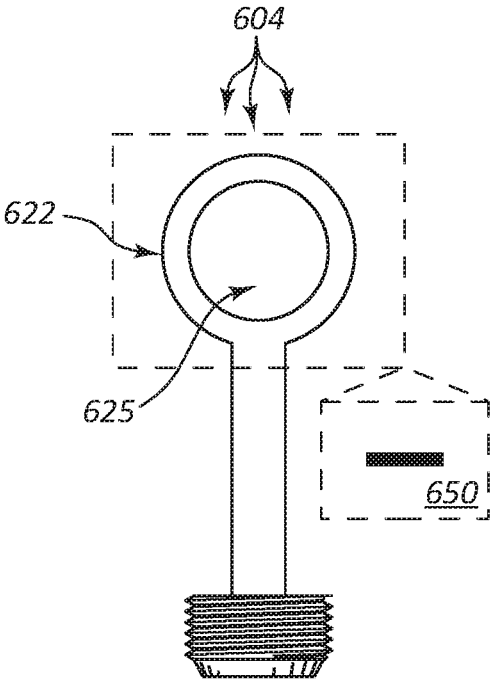
FIG. 6 illustrates a front profile view of yet another exemplary removable stopper.

FIG. 6 illustrates a removable stopper 604 having a ring-shaped handle 622 defining an aperture 625. In some embodiments, the aperture is sized and shaped to admit one or more of the user's digits so that a user can push, pull, and/or twist the removable stopper 604 by manipulating the handle 622 with their digit(s). As shown in the accompanying aerial view, the ring-shaped handle 622 is a single annular projection.

Figure 7:
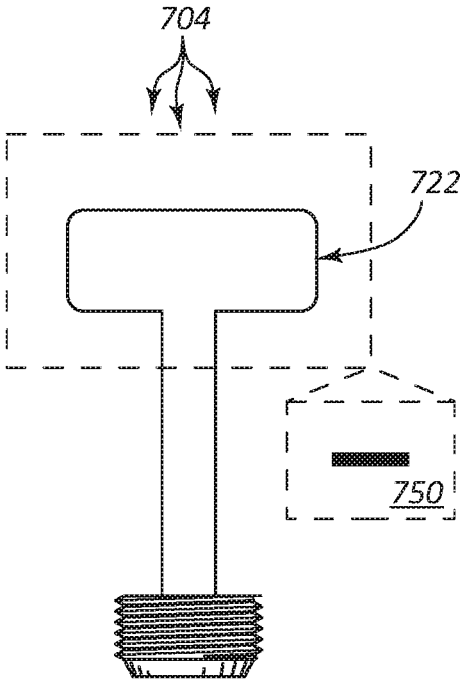
FIG. 7 illustrates a front profile view of still another exemplary removable stopper.

FIG. 7 illustrates a removable stopper 704 having a paddle-shaped handle 722. As shown in the accompanying aerial view, the paddle-shaped handle is a substantially flat, elongate member.

Figure 8:
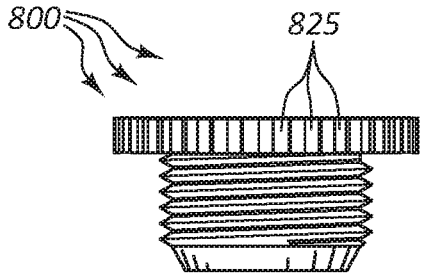
FIG. 8 illustrates a front profile view of an exemplary sealing cap.

Referring now to FIGS. 8-13, illustrated are exemplary embodiments of sealing caps that can be used in one or more sample collection systems disclosed herein. In each of FIGS. 8-10, the exemplary sealing caps are sized and shaped to fit within the opening of an associated sample collection vessel. FIG. 8, for example, includes a sealing cap 800 with threads configured to interlock with threads on an interior sidewall of the sample collection chamber and which define the opening. The sealing cap 800 includes a top having gripping members 825 to provide a user with improved gripability when manipulating the sealing cap 800. In one or more implementations, the sealing cap 800 is threaded into the opening, where the interlocking threads act to create a fluid-tight and/or airtight seal. In some embodiments, there is a seal disposed on the underside of the top, such as an O-ring, that acts to seal the opening when associated therewith.

Figure 9:
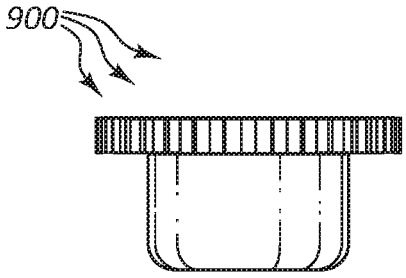
FIG. 9 illustrates a front profile view of another exemplary sealing cap.

FIG. 9 illustrates a sealing cap 900 configured in size and shape to fit within the opening of a smooth-walled sample collection chamber, forming an interference fit therewith (and thereby occluding the opening and sealing the contents of the sample collection chamber). In some embodiments, the sealing cap 900 is made from rubber, silicone, thermoplastic elastomer, or similar material that can flex to tightly fit within the opening but which is also rigid enough to maintain a seal when placed therein.

Figure 10:
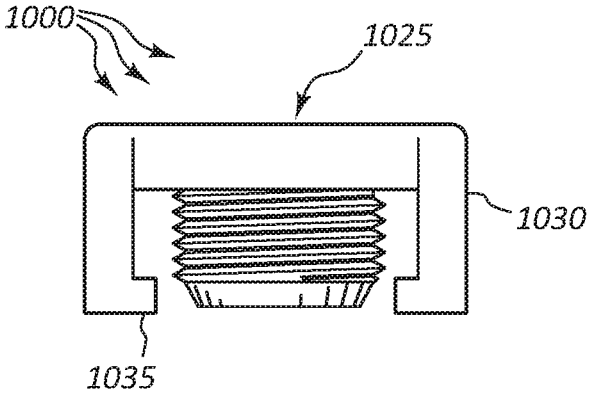
FIG. 10 illustrates a front profile view of yet another exemplary sealing cap.

FIG. 10 illustrates a sealing cap 1000 that includes a top member coupled to a plug that is sized and shaped to fit within the opening of a sample collection chamber. The sealing cap 1000 additionally includes downwardly projecting arms 1030 and flanges 1035, which in some embodiments, can secure to an outer portion of the sample collection vessel. For example, arms 1030 can be of an appropriate length to position the flanges 1035 below a connection member disposed on an exterior surface of the sample collection vessel. The flanges 1035 can, in some embodiments, act as complementary connection members to provide additional structural reinforcement to the seal.

Figure 11:
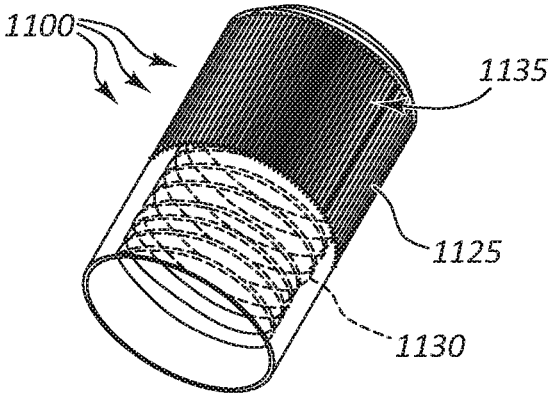
FIG. 11 illustrates a front profile view of still another exemplary sealing cap.

FIG. 11 illustrates a sealing cap 1100 having grip members 1125 (illustrated as a plurality of ridges), interior threads 1130, and a seal 1135 (illustrated as an O-ring). In some implementations, the sealing cap 1100 can be advanced onto the sample collection vessel until the opening is sealed (e.g., by fluid-tight/airtight occlusion of the opening or by association of the opening with a seal 1135 inside the sealing cap, which is illustrated in FIG. 11 as an O-ring 1135). Interaction between the opening and the seal 1135 creates a fluid-tight seal, thereby retaining reagents and sample within the reagent chamber.

Figure 12:
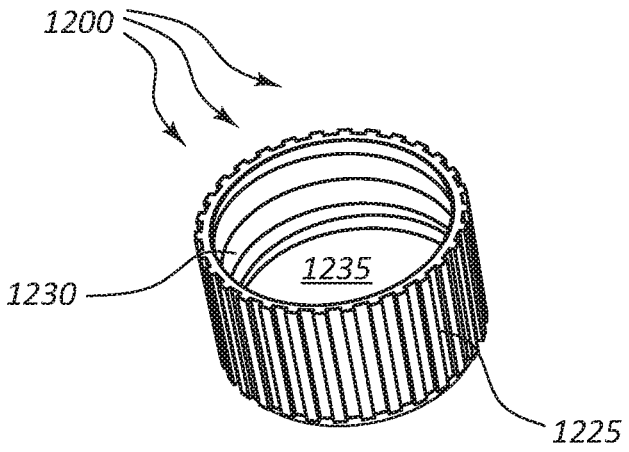
FIG. 12 illustrates a bottom, front perspective view of an exemplary sealing cap.
Figure 13:
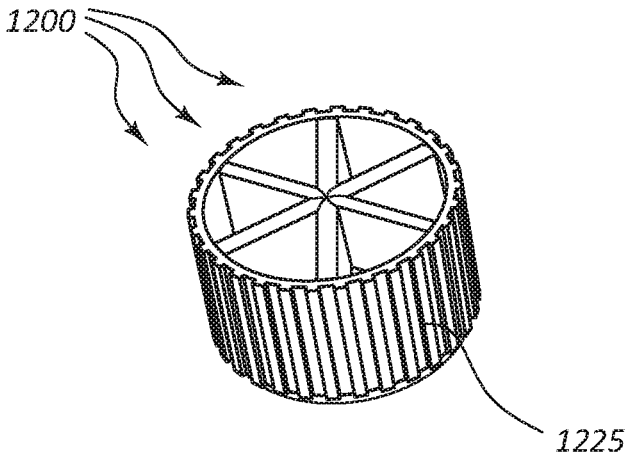
FIG. 13 illustrates a top, front perspective view of the exemplary sealing cap of FIG. 12.

FIGS. 12 and 13 illustrate a sealing cap 1200 having grip members 1225 (illustrated as a plurality of ridges), interior threads 1230, and a seal 1235 (illustrated as a compressible sealing material). In some implementations, the sealing cap 1200 can be advanced onto the sample collection vessel until the opening is sealed (e.g., by fluid-tight/airtight occlusion of the opening or by association of the opening with a seal 1235 inside the sealing cap). Interaction between the opening and the seal 1235 creates a fluid-tight seal, thereby retaining reagents and sample within the reagent chamber. As shown in FIG. 13, the sealing cap 1200 can additionally include a plurality of spokes connecting to an interior sidewall of the sealing cap.

It should be appreciated that any of the foregoing sample collection vessels, funnels, removable stoppers, and sealing caps can be combined in any combination for use in kits for collecting and preserving a biological sample.

Figure 14:
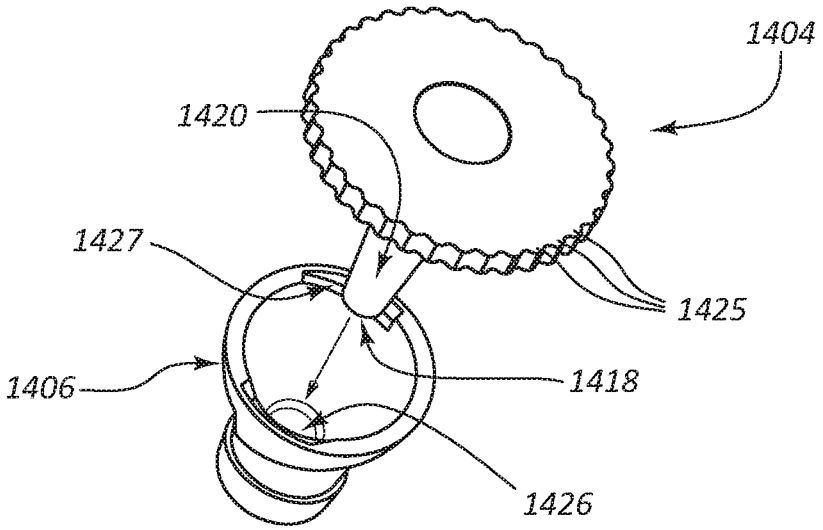
FIG. 14 illustrates a top, right perspective view of an exploded view of an exemplary removable stopper and an associated funnel.
Figure 15:
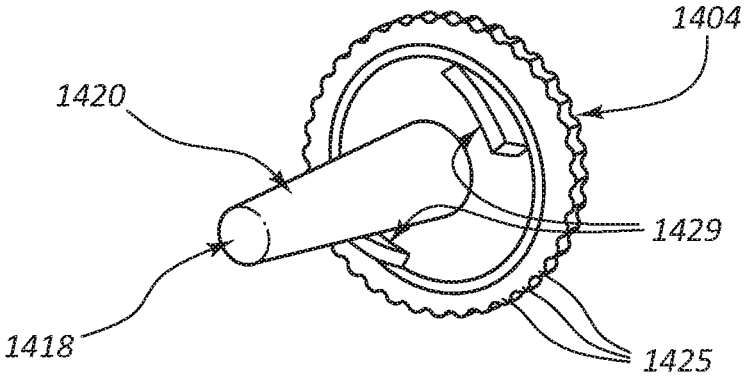
FIG. 15 illustrates a bottom, right perspective view of the exemplary removable stopper from FIG. 14.
Figure 16:
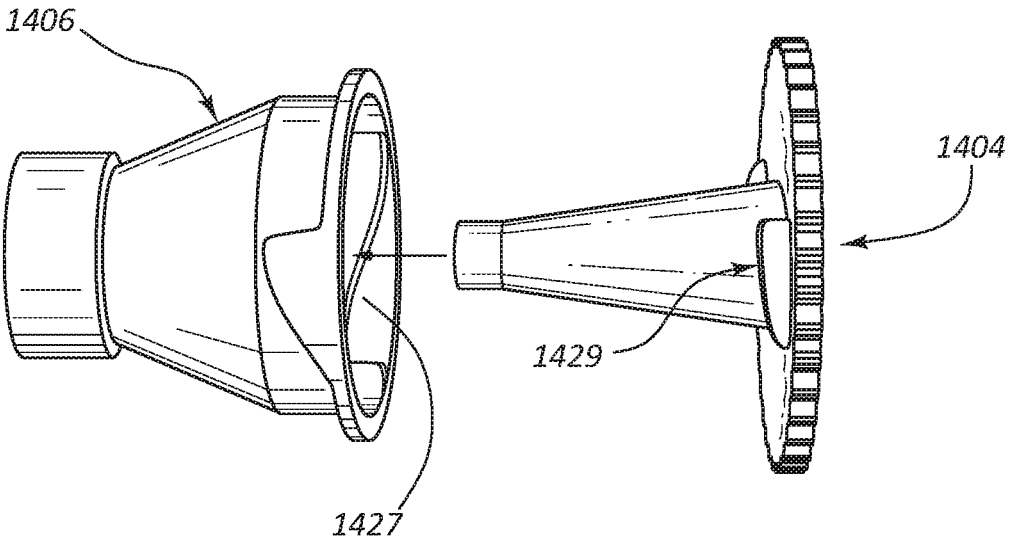
FIG. 16 illustrates a top plan view of an exploded view of the exemplary removable stopper and an associated funnel of FIG. 14.

Referring now to FIGS. 14-17, illustrated is an exemplary embodiment of a funnel 1406 and an associated removable stopper 1404. As above, the funnel 1406 can be configured to selectively associate with the sample collection vessel such that fluid communication is achieved between an upper funnel opening and the sample collection chamber. For example, the funnel may include a set of interior threads that engage complementary threads disposed on an exterior surface of the sample collection vessel. In some embodiments, and as depicted in FIGS. 14 and 16, the funnel 1406 includes a ramp 1427 disposed on an interior surface thereof. The ramp 1427 comprises an arcuate inclined plane that conforms to the contour of the inner sidewall of the funnel 1406. As illustrated in FIGS. 14 and 16, the ramp 1427 is cut into the interior sidewall. In additional or alternative embodiments, the ramp can extend as a ledge or protrusion from the interior sidewall.

The ramp 1427 is illustrated as spanning an arc length created between circumferential ends of two radii that from an angle therebetween that is less than 90° therebetween. It should be appreciated, however, that the ramp can extend along any distance of the circumference of the interior sidewall and have any corresponding arc length, including for example, arc lengths created between circumferential ends of two radii that from an angle therebetween that is less than 270°, less than 180°, less than 150°, less than 135°, less than 120°, less than 75°, less than 60°, less than 45°, less than 30°, or less than 20° therebetween. The grade of the ramp can be any grade paired with any of the foregoing arc lengths that allows the removable stopper to engage and selectively secure the funnel.

In some embodiments, the removable stopper 1404 includes a tapered ridge 1429 that is complementary to the ramp 1427 and which is sized and shaped to engage the ramp 1427, thereby causing the removable stopper and the funnel to be operably connected. For example, the tapered ridge 1429 and the ramp 1427 can form a friction fit, interference fit, threaded fit, interlocking fit, or any other mechanical fit known in the art. In the case of a friction fit, the ramp 1427 bears outwardly against the tapered ridge 1429 when the removable stopper 1407 is turned in an unlocking or opening direction to force or pry the removable stopper 1407 away from and outer of engagement with the funnel 1406.

In some embodiments, the grade of the ramp and/or the tapered ridge can be any grade that allows the removable stopper to engage and be selectively secured to the funnel when in the closed position and cause or permit the removable stopper to be disengaged from the funnel when rotated in an opening direction. It should be appreciated that any number or combination of tapered ridges and corresponding ramps can be included on a removable stopper and funnel, respectively. For example, as shown in the Figures, there are two tapered ridges and two corresponding ramps positioned opposite each other (e.g., on opposite sides and/or having starting points positioned about 180° apart). In some embodiments, there may be three tapered ridge-ramp pairs, each of which are spaced at equal intervals from each other or at unequal intervals. In some embodiments, there may be 4, 5, 6, 7, 8, or more tapered ridge-ramp pairs, which may each be equally spaced or a subset of which are equally spaced. In some embodiments, the ramps are the negative space defined by graded ridges cut into the sidewall of the funnel.

Figure 17:
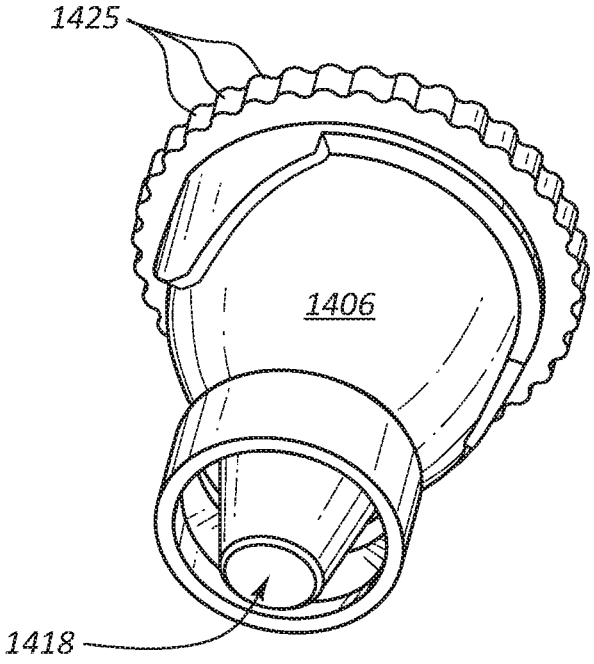
FIG. 17 illustrates a bottom, right perspective view of the exemplary removable stopper of FIG. 14 associated with the associated funnel of FIG. 14.

In some embodiments, the removable stopper 1404 includes gripping members 1425 on a peripheral edge of a disc-shaped handle that can assist a user in securing and/or unsecuring the removable stopper 1404 from the funnel 1406. The removable stopper 1404 can be associated with the funnel 1406 by placing the stem 1420 into an inner region defined by the interior sidewall of the funnel. The stem can be advanced until the plug 1418 occludes and/or seals the bottom opening of the funnel 1406 and/or the sample collection chamber (as shown in FIG. 17). This foregoing selective securement can additionally include the tapered ridge 1429 engaging the ramp 1427 such that in some embodiments, the ramp 1427 and tapered ridge 1429 are associated to selectively secure the removable stopper to the funnel while simultaneously the plug 1418 seals the funnel 1406 and/or sample collection chamber.

As shown in the Figures, the stem 1420 is tapered from a larger diameter (disposed closer to the handle) to a smaller diameter terminating in a plug 1418. In some embodiments, the plug is the same material as the stem and is defined as the region of the stem that creates a seal between the removable stopper and the funnel and/or the sample collection chamber. In some embodiments, the plug includes a different material than the stem. For example, the plug can include an elastomer, thermoplastic elastomer, rubber, silicone, or other material that can compress to form a seal. In some embodiments, the seal between the plug and the funnel and/or sample collection chamber is formed by an interference fit.

Additionally, the systems and kits disclosed herein can be used as a part of one or more methods for collecting and preserving a biological sample. An exemplary method includes displacing a removable stopper from an opening of a sample collection chamber, receiving a biological sample from a user through the opening such that the biological sample mixes with a preservation reagent disposed within the sample collection chamber, and sealing the opening. In some embodiments, the biological sample is received from a mouth of the user at a funnel coupled to and in fluid communication with the opening, and subsequent to receiving the biological sample, the funnel is removed and the opening is sealed by coupling a sealing cap to the sample collection vessel.

Unless defined otherwise, all technical and scientific terms used herein have the same meaning as commonly understood by one of ordinary skill in the art to which the present disclosure pertains.

Various aspects of the present disclosure, including devices, systems, and methods may be illustrated with reference to one or more embodiments or implementations, which are exemplary in nature. As used herein, the term "exemplary" means "serving as an example, instance, or illustration," and should not necessarily be construed as preferred or advantageous over other embodiments disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

As used throughout this application the words "can" and "may" are used in a permissive sense (i.e., meaning having the potential to), rather than the mandatory sense (i.e., meaning must). Additionally, the terms "including," "having," "involving," "containing," "characterized by," as well as variants thereof (e.g., "includes," "has," "involves," "contains," etc.), and similar terms as used herein, including within the claims, shall be inclusive and/or open-ended, shall have the same meaning as the word "comprising" and variants thereof (e.g., "comprise" and "comprises"), and do not exclude additional un-recited elements or method steps, illustratively.

It will be noted that, as used in this specification and the appended claims, the singular forms "a," "an" and "the" include plural referents unless the context clearly dictates otherwise. Thus, for example, reference to a singular referent (e.g., "widget") includes one, two, or more referents. Similarly, reference to a plurality of referents should be interpreted as comprising a single referent and/or a plurality of referents unless the content and/or context clearly dictate otherwise. For example, reference to referents in the plural form (e.g., "widgets") does not necessarily require a plurality of such referents. Instead, it will be appreciated that independent of the inferred number of referents, one or more referents are contemplated herein unless stated otherwise.

As used herein, directional terms, such as "top," "bottom," "left," "right," "up," "down," "upper," "lower," "proximal," "distal" and the like are used herein solely to indicate relative directions and are not otherwise intended to limit the scope of the disclosure and/or claimed invention.

To facilitate understanding, like reference numerals (i.e., like numbering of components and/or elements) have been used, where possible, to designate like elements common to the figures. Specifically, in the exemplary embodiments illustrated in the figures, like structures, or structures with like functions, will be provided with similar reference designations, where possible. Specific language will be used herein to describe the exemplary embodiments. Nevertheless it will be understood that no limitation of the scope of the disclosure is thereby intended. Rather, it is to be understood that the language used to describe the exemplary embodiments is illustrative only and is not to be construed as limiting the scope of the disclosure (unless such language is expressly described herein as essential).

Any headings used herein are for organizational purposes only and are not meant to be used to limit the scope of the description or the claims.

Various aspects of the present disclosure can be illustrated by describing components that are bound, coupled, attached, connected, and/or joined together. As used herein, the terms "bound," "coupled", "attached", "connected," and/or "joined" are used to indicate either a direct association between two components or, where appropriate, an indirect association with one another through intervening or intermediate components. In contrast, when a component is referred to as being "directly bound," "directly coupled", "directly attached", "directly connected," and/or "directly joined" to another component, no intervening elements are present or contemplated. Furthermore, binding, coupling, attaching, connecting, and/or joining can comprise mechanical and/or chemical association.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, devices, products, kits, methods, and/or processes, according to certain embodiments of the present disclosure may include, incorporate, or otherwise comprise properties, features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A biological sample collection system, comprising:

a sample collection vessel, the sample collection vessel comprising:

an opening disposed at a top portion of the sample collection vessel;

a sample collection chamber in fluid communication with the opening, the sample collection chamber having a sample preservation reagent disposed therein; and a connection member disposed on an exterior portion of the sample collection vessel;

a funnel configured to selectively couple to the opening, wherein a funnel opening and the opening of the sample collection vessel are in fluid communication when the funnel is selectively coupled to the opening;

a removable stopper comprising a stem, a handle coupled to a first end of the stem, and a plug coupled to an opposing second end of the stem, the plug being sized and shaped to fit within and seal one or more of the opening of the sample collection vessel or the funnel opening; and a sealing cap, comprising:

a seal configured to seal the opening; and a complementary connection member configured to associate with the connection member of the sample collection vessel, wherein the seal engages and seals the opening when the complementary connection member associates with the connection member.

2. The biological sample collection system of claim 1, wherein the plug creates an airtight seal when disposed within the opening of the sample collection vessel.

3. The biological sample collection system of claim 1, wherein the handle comprises a paddle that is oriented in a plane transverse to or aligned with a longitudinal axis of at least one of the stem or plug.

4. The biological sample collection system of claim 1, wherein the handle comprises a disc oriented in a plane transverse to a longitudinal axis of at least one of the stem or plug.

5. The biological sample collection system of claim 1, wherein the handle comprises a fin having a plurality of flanges, each flange comprising an elongate ridge disposed along and projecting outwardly away from a central body of the fin.

6. The biological sample collection system of claim 1, wherein the seal comprises an O-ring.

7. The biological sample collection system of claim 1, wherein the connection member and the complementary connection member comprise threads.

8. The biological sample collection system of claim 1, wherein the funnel opening is an enlarged opening at a first end of the funnel for receiving a biological sample and a second complementary connection member at a second end opposite the first end and configured to associate with the connection member of the sample collection vessel.

9. The biological sample collection system of claim 8, wherein the second complementary connection member comprises internal threads.

10. A method for collecting and preserving a biological sample in a sample collection vessel, comprising:

providing a biological sample collection system comprised of:

a sample collection vessel, the sample collection vessel comprising:

an opening disposed at a top portion of the sample collection vessel;

a sample collection chamber in fluid communication with the opening, the sample collection chamber having a sample preservation reagent disposed therein; and a connection member disposed on an exterior portion of the sample collection vessel;

a funnel configured to selectively couple to the opening, wherein a funnel opening and the opening of the sample collection vessel are in fluid communication when the funnel is selectively coupled to the opening;

a removable stopper comprising a plug that is sized and shaped to fit within and seal one or more of the opening of the sample collection vessel or the funnel opening; and a sealing cap, comprising:

a seal configured to seal the opening; and a complementary connection member configured to associate with the connection member of the sample collection vessel, wherein the seal engages and seals the opening when the complementary connection member associates with the connection member;

displacing the removable stopper from the opening of the sample collection vessel;

receiving a biological sample from a user through the funnel opening and into the sample collection chamber such that the biological sample mixes with a preservation reagent disposed within the sample collection chamber; and sealing the opening.

11. The method as in claim 10, wherein the biological sample is received from a mouth of the user at the funnel when coupled to and in fluid communication with the opening of the sample collection vessel.

12. A biological sample collection system, comprising:

a sample collection vessel, the sample collection vessel comprising:

an opening disposed at a top portion of the sample collection vessel and formed by a sidewall of the sample collection vessel; and a sample collection chamber in fluid communication with the opening, the sample collection chamber having a sample preservation reagent disposed therein;

a funnel coupled to the sidewall at the opening of the sample collection vessel, the funnel comprising a funnel opening in fluid communication with the sample collection chamber; and a removable stopper comprising a stem, a handle coupled to a first end of the stem, and a plug coupled to an opposing second end of the stem, the plug being configured to seal the funnel opening.

13. The biological sample collection system of claim 12, wherein the plug seals the funnel opening through an interference fit.

14. The biological sample collection system of claim 12, wherein the funnel further comprises a ramp disposed on an interior surface of a top portion thereof.

15. The biological sample collection system as in claim 14, wherein the handle comprises a tapered ridge, and wherein the tapered ridge is sized and shaped to selectively associate with the ramp.

16. The biological sample collection system as in claim 15, wherein association of the tapered ridge with the ramp selectively secures the removable stopper to the funnel and seals the funnel opening with the plug.

17. A biological sample collection system, comprising:

a sample collection chamber comprising an opening disposed at a top portion of the sample collection chamber;

a sample preservation reagent disposed with in the sample collection chamber;

a funnel configured to selectively couple to the opening, the funnel comprising an inner sidewall forming a funnel opening and defining a ramp; and a removable stopper comprising a stem, a handle coupled to a first end of the stem, and a plug coupled to an opposing second end of the stem, wherein the removable stopper is configured to seal the funnel opening upon engagement of the removable stopper with the funnel.

18. The biological sample collection system of claim 17, wherein the handle comprises a tapered ridge, and wherein engagement of the removable stopper with the funnel comprises selectively securing the tapered ridge with the ramp and causing the plug to seal the funnel opening.

19. A biological sample collection system, comprising:

a sample collection vessel, the sample collection vessel comprising:

an opening disposed at a top portion of the sample collection vessel;

a sample collection chamber in fluid communication with the opening, the sample collection chamber having a sample preservation reagent disposed therein; and a connection member disposed on an exterior portion of the sample collection vessel;

a funnel configured to selectively couple to the opening, wherein a funnel opening and the opening of the sample collection vessel are in fluid communication when the funnel is selectively coupled to the opening;

a removable stopper comprising a plug that is sized and shaped to fit within and seal the opening of the sample collection vessel, wherein the plug creates an airtight seal when disposed within the opening of the sample collection vessel; and a sealing cap, comprising:

a seal configured to seal the opening; and a complementary connection member configured to associate with the connection member of the sample collection vessel, wherein the seal engages and seals the opening when the complementary connection member associates with the connection member.

* * * * *